US006811395B2

(12) United States Patent
Schlecht

(10) Patent No.: US 6,811,395 B2
(45) Date of Patent: Nov. 2, 2004

(54) COMBUSTION CHAMBER ASSEMBLY, PARTICULARLY FOR A VEHICLE HEATING DEVICE

(75) Inventor: Patric Schlecht, Ostfildern (DE)

(73) Assignee: J. Eberspacher GmbH & Co. KG, Esslingen (DE)

( * ) Notice: Subject to any disclaimer, the term of this patent is extended or adjusted under 35 U.S.C. 154(b) by 0 days.

(21) Appl. No.: 10/339,140

(22) Filed: Jan. 9, 2003

(65) Prior Publication Data

US 2003/0138751 A1 Jul. 24, 2003

(30) Foreign Application Priority Data

Jan. 9, 2002 (DE) ..... 102 00 524

(51) Int. Cl.[7] ..... F23Q 3/00

(52) U.S. Cl. ..... 431/261; 431/263; 431/326; 431/350; 237/12.3 C

(58) Field of Search ..... 431/261–264, 431/326, 327, 328, 266; 126/116 R, 95, 96, 110 B; 237/12.3 C

(56) References Cited

U.S. PATENT DOCUMENTS

| | | | | |
|---|---|---|---|---|
| 3,543,742 A | | 12/1970 | Stump et al. | |
| 4,471,754 A | | 9/1984 | Galtz | |
| 4,623,310 A | | 11/1986 | Kimijima et al. | |
| 5,947,717 A | | 9/1999 | Steiner et al. | |
| 6,027,334 A | | 2/2000 | Blaschke | |
| 6,164,554 A | * | 12/2000 | Pfister et al. | 237/12.3 C |
| 6,213,406 B1 | * | 4/2001 | Kenzi et al. | 237/12.3 C |

FOREIGN PATENT DOCUMENTS

| | | | |
|---|---|---|---|
| DE | 1 257 396 | 12/1967 | |
| DE | 41 11 915 C2 | 10/1993 | F23M/9/06 |
| DE | 43 19 775 A1 | 2/1994 | |
| DE | 43 04 057 A1 | 8/1994 | F23C/9/06 |
| DE | 195 29 994 A1 | 8/1995 | F23D/5/00 |

* cited by examiner

*Primary Examiner*—James C. Yeung

(57) ABSTRACT

A combustion chamber assembly, in particular for a vehicle heating device, has combustion chamber housing in which a combustion chamber is bounded by a combustion chamber outer wall, the combustion chamber having a combustion chamber outlet aperture for the exit to a flame tube of exhaust gases produced during combustion, furthermore comprising a deflecting arrangement for deflecting at least a partial stream of the exhaust gases leaving the combustion chamber to flow along at least a partial region of the outer side of the combustion chamber outer wall facing away from the combustion chamber.

4 Claims, 1 Drawing Sheet

COMBUSTION CHAMBER ASSEMBLY, PARTICULARLY FOR A VEHICLE HEATING DEVICE

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a combustion chamber assembly, particularly for a vehicle heating device, comprising a combustion chamber housing in which a combustion chamber is bounded by a combustion chamber outer wall, the combustion chamber having a combustion chamber outlet aperture for the exit to a flame tube of exhaust gases produced during combustion.

Such a combustion chamber assembly, such as is generally used in heating devices used as vehicle auxiliary heaters or supplementary heaters, is shown in FIG. 1. This assembly 10*s* known from the prior art includes a combustion chamber housing 12*s* which bounds a combustion chamber 16*s* radially outwardly with an approximately cylindrical outer wall 14*a*. From a floor region 18*s* of the combustion chamber housing 12*s* there extends, coaxially of the outer wall 14*s* and with respect to a longitudinal axis A of the combustion chamber assembly 10*s*, an approximately cylindrical inner wall 20*s*, which is axially closed by a closure region 22*s*. The outer wall 14*s* and the inner wall 20*s* thus define a combustion chamber 16*s* with an approximately annular shape, which in the region of a corresponding annular outlet aperture 24*s* is axially open toward a flame tube 26*s* adjoining the combustion chamber housing 12*s*. Plural air inlet apertures 28*s* are provided in the inner wall 20*s*, and through them, and also by the forwarding effect of a fan (not shown), the combustion air required for combustion can enter the combustion chamber 16*s*.

A lining 32*s*, for example made of nonwoven material or other porous material, is provided on the inner side 30*s*, facing the combustion chamber, of the outer wall 14*a*. A lining 36*s* made of knitted metal fabric can also be provided for sound damping reasons on the inner wall 20*s*, on its side 34*a* facing toward the combustion chamber 16*s*. Fuel is introduced into the combustion chamber 16*s* by means of a fuel supply duct 39*s*, for example through an atomizer nozzle (not shown), or else by introduction, for example, into the lining 30*s*, using an evaporative effect. Furthermore, an ignition element (not shown), for example a glow ignition pin, projects into the combustion chamber 16*s*, and at the beginning of an operating phase makes sure that the fuel reaching the combustion chamber 16*s* by atomization or evaporation ignites and that the combustion thus begins.

The exhaust gases produced in the combustion in the combustion chamber 16*s* or respectively also the combustion flame pass out of the combustion chamber housing 12*s* in the region of the outlet aperture 24*s* and flow, as indicated by arrows, through a central aperture 38*s* of an exhaust gas diaphragm 40*s* positioned in the flame tube 26*s* opposite the outlet aperture 24*s* of the combustion chamber housing 12*s*. The very hot gases produced by combustion and then flowing along the flame tube 26*s* pass out of the flame tube in the region of a flame tube outlet aperture 42*s* and, as likewise shown by arrows, are deflected by a heat exchanger housing, not shown in the Figure, surrounding the flame tube on the outside, so that they flow back on the outside of the flame tube 26*s* and thereby heat the heat exchanger housing and the medium flowing in the heat exchanger housing. The thus cooled exhaust gases flow back in the direction of the combustion chamber housing 12*s* and then, after they have if necessary flowed along a partial region of the outside 44*s* of the outer wall 14*s* situated remote from the combustion chamber 16*s*, flow out via an exhaust gas duct system into the environment.

A problem in such combustion chamber assemblies, or heating devices having these, is that a comparatively steep temperature drop is present in the axial direction. The temperature in the region of the flame tube is comparatively high, while the temperature in the region of the combustion chamber housing is comparatively low. Also, the exhaust gases conducted back, if necessary, on the outside of the flame tube are already cooled so far that they can no longer contribute to an appreciable heating of the combustion chamber housing. Coking problems result therefrom in the region of the linings 32*s*, 36*s*, the combustion air inlet apertures 28*s*, and the ignition element (not shown). In particular, when fuel is introduced by means of porous materials, using fuel evaporation, the starting phase, i.e., the phase until the required rated power is reached, becomes very long, above all at very low external temperatures.

SUMMARY OF THE INVENTION

The present invention has as its object to develop a combustion chamber assembly of the category concerned, such that the problems arising due to too low temperatures in the region of the combustion chamber housing are substantially eliminated.

According to the invention, this object is attained by a combustion chamber assembly, for a vehicle heating device, comprising a combustion chamber housing in which a combustion chamber is bounded by a combustion chamber outer wall, the combustion chamber having a combustion chamber outlet aperture to exit to a flame tube of exhaust gases produced during combustion, wherein a deflecting arrangement deflects at least a partial stream of the exhaust gases leaving the combustion chamber to flow along at least one partial region of an outer side of the combustion chamber outer wall facing away from the combustion chamber, before entering into the flame tube.

The present invention thus uses at least a portion of the exhaust gases produced in the combustion and thus very hot, in order to conduct these, directly on leaving the combustion chamber housing and still before entering the flame tube, into a region in which they can contribute to substantial heating of the combustion chamber housing. This leads to a marked reduction of the amount of soot accumulating during combustion, and correspondingly also to a marked reduction of the deposits occurring in the combustion chamber region. The heating of the combustion chamber assembly makes sure at the same time that the starting phase can be shortened, since the combustion propagating over the whole combustion chamber will run at a higher temperature from the beginning.

For example, it can be provided that the deflecting arrangement includes a deflecting diaphragm situated opposite the combustion chamber outlet aperture. In order to make sure of a reliable deflection of exhaust gases leaving the combustion chamber, it is proposed that the deflecting diaphragm at least regionally overlaps the combustion chamber housing with a diaphragm outer wall.

The heating of the combustion chamber housing produced according to the present invention does not in general require that the whole of the exhaust gases arising in the combustion are used to obtain heat transfer to the combustion chamber housing. It is therefore proposed that the deflecting diaphragm has in a diaphragm end wall a passage aperture, which is positioned opposite the combustion chamber outlet aperture and preferably has a smaller dimension than the combustion chamber outlet aperture. It is ensured in this manner that only a partial stream of the exhaust gases flowing out of the combustion chamber outlet aperture is deflected for using its heat, while a further portion of the exhaust gases arising in the combustion flows directly into the flame tube.

By the division into two partial streams, namely a main stream which flows directly into the flame tube and a partial stream deflected for heating and only after this conducted into the flame tube, a construction is provided which operates on the injector principle, and in which a reduced pressure is produced by the partial stream flowing directly into the flame tube, and is substantially responsible for the deflection, in a defined manner by means of the deflecting diaphragm, of a portion of the gases or exhaust gases leaving the combustion chamber, to flow around the combustion chamber housing on its outer side.

An embodiment, which is particularly advantageous from the standpoint of flow technology, proposes that the deflecting diaphragm is constituted in a hollow frustroconical shape and that the combustion chamber housing engages into the deflecting diaphragm. It can furthermore be provided that a flow channel region is formed between the deflecting diaphragm and the flame tube, leading the deflected exhaust gas stream toward a flame tube outlet aperture. This flow channel region has a throttling function, so that by means of the rating of the flow cross section in this region, and also taking into account the previously described reduced pressure produced by the main flow going directly into the flame tube, the flow rate of the exhaust gases contributing directly to combustion chamber housing heating can be adjusted, The present invention furthermore relates to a heating device, particularly for a vehicle, in which heating device a combustion chamber assembly according to the invention is provided.

BRIEF DESCRIPTION OF THE DRAWINGS

The combustion chamber assembly according to the invention is described hereinafter with reference to the accompanying drawings.

DETAILED DESCRIPTION OF THE INVENTION

Figure 1:
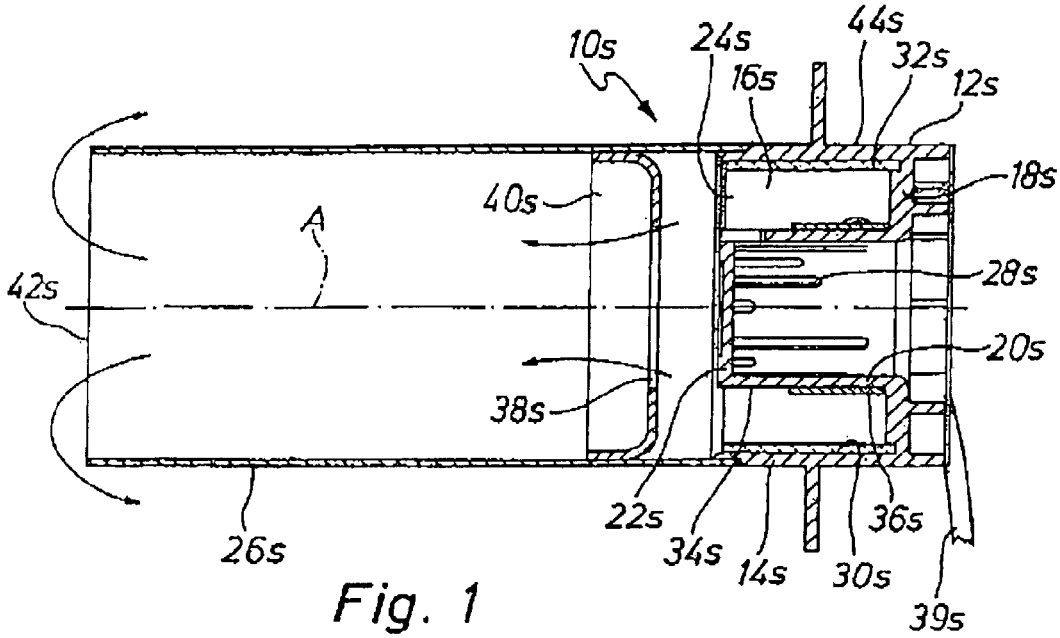
Fig. 1 Prior Art
FIG. 1 shows a longitudinal sectional diagram of a combustion chamber assembly known from the prior art.
Figure 2:
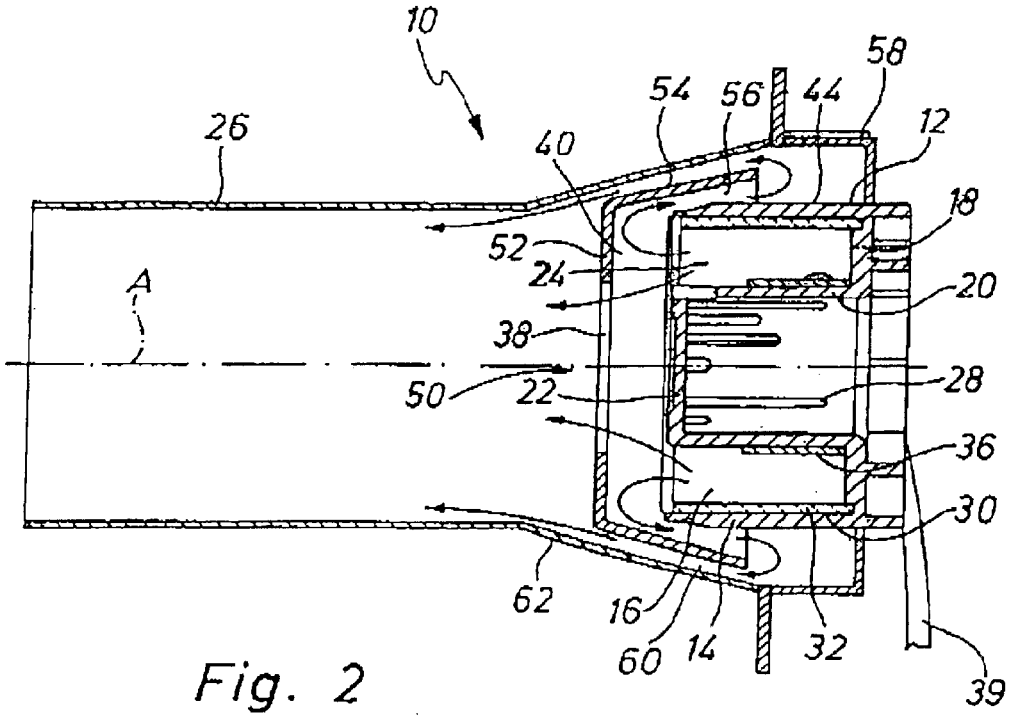
FIG. 2 shows a longitudinal sectional diagram of a combustion chamber assembly according to the invention.

The combustion chamber assembly 10 according to the invention, shown in FIG. 2 corresponds, as regards essential constructional features, to the combustion chamber assembly already discussed in detail with reference to FIG. 1 and known from the prior art. Thus the combustion chamber assembly 10 according to the invention also has a combustion chamber housing 12 with an outer wall 14 and an inner wall 20, which bound between them an approximately annular combustion chamber 16. This is axially open via the combustion chamber outlet aperture 24. A lining 32 is provided on the inner side of the outer wall 14 facing toward the combustion chamber 16. In a corresponding manner, a further lining 36 is also present on the inner wall 20.

The exhaust gas diaphragm 40 forms, in the combustion chamber assembly 10 according to the invention, a deflecting arrangement generally denoted by 50. It can be seen that also in this exhaust gas diaphragm 40 a central aperture 38 is present, about concentric with the longitudinal axis A, and has an outer dimension, thus for example diameter, which is smaller than the corresponding outer dimension of the combustion chamber 16, this outer dimension being substantially predetermined by the outer wall 14 or the lining 32. The exhaust gas diaphragm 40 has an outer wall 54, bordering radially outward on its end wall 52 situated opposite the outlet aperture 24. The outer wall 54 and the end wall 52 together substantially form a frustroconical pot shape, wherein as can be seen in FIG. 2 the outer wall 54 is proportioned, at least in a partial region, so that it has a greater dimension, again for example diameter, than the outer wall 14 of the combustion chamber housing 12. The exhaust gas diaphragm 40 is positioned so that axially it at least partially overlaps the combustion chamber housing 12. As a result, an annular flow space 56 is formed between the outer wall 14 of the combustion chamber housing 12 and the outer wall 54 of the exhaust gas diaphragm 40, through which flow space 56 at least a portion of the exhaust gases will flow which strike the end wall 52 and thus are deflected by this end wall 52 and also the outer wall 54. This exhaust gases thus flow along the outside 44 of the outer wall 14 of the combustion chamber housing 12 and thus transfer their heat to the combustion chamber housing 12. After the exhaust gases, having a very high temperature, have flowed along this outer side 44, they are deflected again by a further housing 58 surrounding the combustion chamber housing radially outward, and now reach a further flow channel region 60 which is formed between the outer wall 54 of the exhaust gas diaphragm 40 and a section 62 of the flame tube which is conically widened corresponding to the shape given to the outer wall of the exhaust gas diaphragm 40.

After flowing through this region 62, the exhaust gas stream, previously twice axially deflected, flows in that region of the flame tube 26 in which the exhaust gas partial stream flows which has passed directly out of the outlet aperture 24 and has arrived through the passage aperture 38 of the exhaust gas diaphragm 40. The partial stream of gases or exhaust gases entering the flame tube 26 directly through the passage aperture 38 thus produces with such an arrangement a reduced pressure in the radially outer region, i.e. also in that region in which the flow channel region 60 then opens into the remaining portion of the flame tube 26. This reduced pressure is also substantially responsible for the gases striking the exhaust gas diaphragm 40 being at least partially conducted around radially outward and thus reaching the space region 56 at the outer side 44 of the outer wall 14. The exhaust gas diaphragm 40 thus has the essential function of predetermining the flow path for the deflected exhaust gases, above all delivered by means of a reduced pressure effect, and thus of making sure that the outer side 44 of the outer wall 14 has the desired amount of flow around it and is thus heated.

Thus by the design of the combustion chamber assembly 10 according to the invention it is attained that a portion of the exhaust gases leaving the combustion chamber 16 with a very high temperature is used, still before entering the flame tube 26, in order to transfer at least a portion of the heat arising in the combustion to the combustion chamber housing 12 itself. Trials have shown that an increase of the temperature of the combustion chamber housing 12, particularly in the region of the floor 18, by about 280° C. can be attained, so that the temperature in this region very quickly reaches values between 400° C. and 500° C. Besides the rapid attainment of high temperatures, a markedly more uniform temperature distribution is also attained, with the consequence that the starting phase of ignition and running up to the required rated power can be markedly shortened. The principle of the invention is furthermore substantially independent of the fuel used, since the temperatures produced in the region of the combustion chamber are above the boiling temperatures of the fuels used for such combustion chambers or for heating devices having these, such as diesel or heating oil. Besides a markedly more efficient operation, furthermore a marked reduction of the soot fractions produced during combustion, and of the deposits deposited in the region of the walls bounding the combustion chamber, can be attained.

What is claimed is:

1. Combustion chamber assembly, for a vehicle heating device, comprising a combustion chamber housing in which a combustion chamber is bounded by a combustion chamber outer wall, the combustion chamber having a combustion chamber outlet aperture to exit to a flame tube of exhaust gases produced during combustion, wherein a deflecting arrangement deflects at least a partial stream of the exhaust gases leaving the combustion chamber to flow along at leant one partial region of an outer side of the combustion chamber outer wall facing away from the combustion chamber, before entering into the flame tube, wherein the deflecting arrangement includes a deflecting diaphragm situated opposite the combustion chamber outlet aperture, wherein the deflecting diaphragm comprises a passage aperture in a diaphragm end wall, situated opposite the combustion chamber outlet aperture and having a smaller dimension than the combustion chamber outlet aperture, and wherein a flow channel region conducting the deflected exhaust gas stream toward a flame outlet aperture is formed between the deflecting diaphragm and the flame tube.

2. Combustion chamber assembly according to claim 1 wherein the deflecting diaphragm overlaps the combustion chamber housing at least regionally with a diaphragm outer wall.

3. Combustion chamber assembly according to claim 1 wherein the deflecting diaphragm comprises a hollow frustroconical shape, and wherein the combustion chamber housing engages in the deflecting diaphragm.

4. Heating device, for a vehicle, including a combustion chamber assembly according to claim 1.

* * * * *